US005100491A

United States Patent [19]

Ijiri et al.

[11] Patent Number: 5,100,491

[45] Date of Patent: Mar. 31, 1992

[54] DIE FOR ATTACHING LABEL TO FLEXIBLE ARTICLE

[75] Inventors: Takao Ijiri; Shoji Sakkiyama, both of Fujinomiya, Japan

[73] Assignee: Terumo Kabushiki Kaisha, Tokyo, Japan

[21] Appl. No.: 449,935

[22] PCT Filed: Jun. 17, 1988

[86] PCT No.: PCT/JP88/00602

§ 371 Date: Feb. 16, 1990

§ 102(e) Date: Feb. 16, 1990

[30] Foreign Application Priority Data

Jun. 17, 1987 [JP] Japan ..... 62-149137

[51] Int. Cl.[5] ..... B25B 11/00

[52] U.S. Cl. ..... 156/220; 156/219; 156/583.1; 269/21

[58] Field of Search ..... 156/583.1, 60, 538, 156/571, 219, 220; 100/215, 216, 218; 269/21, 20

[56] References Cited

U.S. PATENT DOCUMENTS

| | | | |
|---|---|---|---|
| 2,489,837 | 11/1949 | von Hofe | 156/289 |
| 2,492,908 | 12/1949 | von Hofe | 156/538 |
| 3,484,093 | 12/1969 | Mermelstein | 269/21 |
| 3,992,245 | 11/1976 | Franklin | 156/571 |
| 4,253,891 | 3/1981 | Brussel | 156/583.1 X |
| 4,348,252 | 9/1982 | Knoop et al. | 100/218 X |
| 4,392,913 | 7/1983 | Baumli | 156/584 |
| 4,557,713 | 12/1985 | Savich | 156/583.1 X |
| 4,795,518 | 1/1989 | Meinel t al. | 269/21 X |

FOREIGN PATENT DOCUMENTS

| | | |
|---|---|---|
| 50-6800 | 2/1975 | Japan . |
| 60-7286 | 3/1985 | Japan . |

*Primary Examiner*—David A. Simmons
*Assistant Examiner*—J. Sells
*Attorney, Agent, or Firm*—Burns, Doane, Swecker & Mathis

[57] ABSTRACT

A die for the attachment of a label to a flexible article, characterized by being provided with a label suction surface and the label suction surface having a regularly or irregularly jogging part formed in substantially the entire surface thereof and having suction holes disposed as enclosed with the protrusions of the jogging part. This die is capable of heating a label provided on one surface thereof with an adhesive surface formed by the application of a thermosensitive adhesive agent and attaching the heated label uniformly and tightly to the surface of the flexible article.

9 Claims, 3 Drawing Sheets

FIG. 1(a)
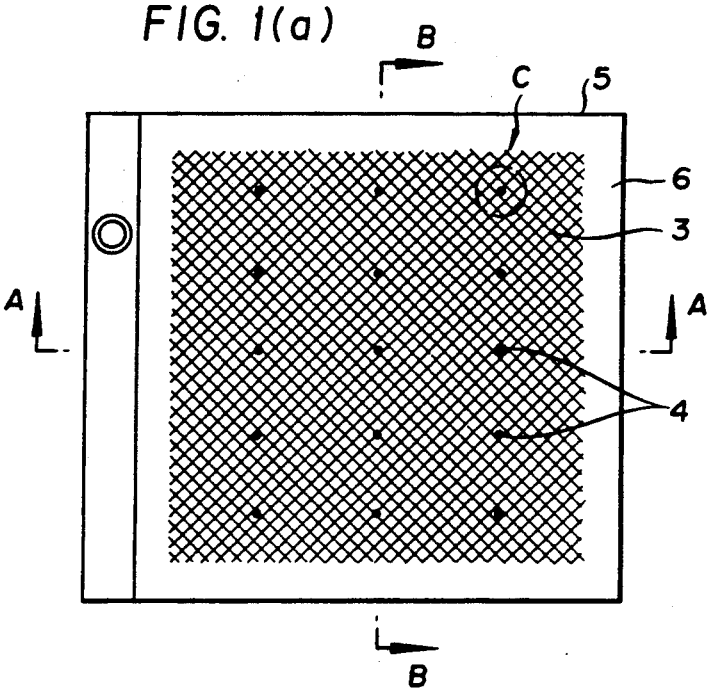
FIG. 1(c)
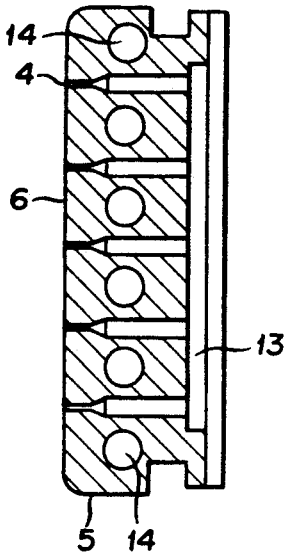
FIG. 1(b)
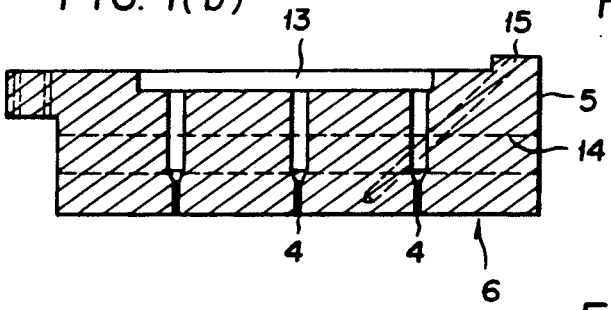
FIG. 1(d)
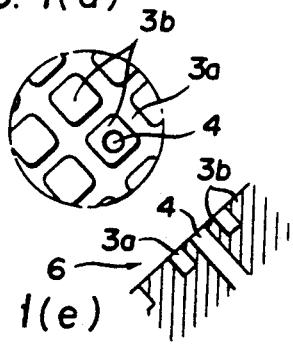
FIG. 1(e)
FIG. 1(f)
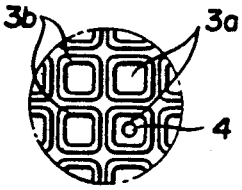
FIG. 1(g)
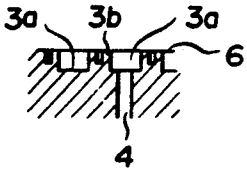

DIE FOR ATTACHING LABEL TO FLEXIBLE ARTICLE

BACKGROUND OF THE INVENTION

1. Field of the Invention

This invention relates to a die for the attachment of a label to the surface of an article. More particularly, this invention relates to a die for heating a label provided on one surface thereof with an adhesive layer and attaching the heated label uniformly and tightly to the surface of a flexible article.

2. Description of the Prior Art

The flexible containers such as blood bags and transfusion bags by nature require attachment to their surface of a label displaying the kind, attributes, etc. of their contents. To date, the practice of preparing a pressure-sensitive label provided with an adhesive layer capable of exhibiting viscosity at normal room temperature and attaching this pressure-sensitive label fast to such flexible articles as the flexible containers mentioned above has prevailed. The pressure-sensitive label so attached to the surface has tended to peel off spontaneously or to be readily peeled off intentionally because the adhesive force of the pressure-sensitive label of this nature is generally weak and the viscous force of the adhesive layer is deteriorated by aging. When the label indicating the blood type (the ABO system, the pH system, etc.) and attached to the blood bag, for example, happens to be peeled off or intentionally or accidentally replaced by other label, there arises the possibility that incompatibility of blood type will occur at the time of transfusion and a serious accident such as fatality on the part of a patient subjected to transfusion will ensue. The use of the pressure-sensitive label of this nature, therefore, can not be called very adequate.

Recently, from this point of view, the method which comprises preparing a label provided on one surface thereof with an adhesive layer formed by the application of a thermosensitive adhesive agent, heating the label, and applying the heated label to the surface of a flexible article has been finding popular acceptance. Since the adhesive force due to the thermosensitive adhesive agent is strong at normal temperature and is deteriorated only slightly by aging, the problem of the peeling of an attached label mentioned above does not occur so long as the label is thoroughly heated and attached uniformly to the surface of the flexible article.

Heretofore, for the purpose of effecting continuous application of such labels to a plurality of flexible articles, it has been customary to prepare a die provided with a suction hole communicating with suction means, keep a suction surface of the die heated as with a heater, cause labels to adhere tightly one after another to the heated suction surface and allow the thermosensitive adhesive agent on the labels to melt, and apply the label by pressure tightly to the surface of flexible articles intended for application of label. Since the suction surface of the die is flat and smooth, when the label which is thin and pliable is attached by suction tightly to the suction surface, there ensues the possibility that a small amount of air is entrapped in the form of clusters of air between the suction surface and the label. In the portion of the label under which such clusters of air are formed as described above, the adhesion of the label to the suction surface is inferior because the clusters of air function as an insulating layer and consequently prevent the heat of the die from being amply transferred to the thermosensitive adhesive agent. Moreover, since the surface of the flexible article such as the blood bag which is intended for application of the label is liable to form a jogging contour particularly when the article is filled with its content, the ambient air finds its way between the label and the surface of the flexible article at the time that the label attached tightly to the die is pressed against the flexible article. In the portion of the label under which the air is entrapped, the label is prevented from contacting the surface of the flexible surface and consequently kept unattached thereto. When the portion of such inferior attachment or no attachment occurs near the edge of the label, even the label using a thermosensitive adhesive agent has the possibility of peeling off the flexible article.

An object of this invention, therefore, is to provide a die for the attachment of a label to a flexible article, which die is improved so as to eliminate the problems heretofore encountered in the attachment of a label to a surface as described above. This invention further concerns a label-attaching die which is adapted to heat a label provided on one surface thereof with an adhesive surface formed by the application of a thermosensitive adhesive agent and attach the heated label uniformly and tightly to the surface of a flexible article. A further object of this invention is to provide a label-attaching die which is capable of effecting the attachment of a label so as to preclude the possibility of the attached label being peeled off the surface.

OBJECTS AND SUMMARY OF A PREFERRED EMBODIMENT OF THE INVENTION

The objects described above are accomplished by a label-attaching die for attaching to a flexible article a label provided on one surface thereof with an adhesive surface formed by the application of a thermosensitive adhesive agent, which label-attaching die is characterized by being provided with a label suction surface and the label suction surface having a regularly or irregularly jogging part formed on the substantially entire surface thereof and having suction holes disposed as enclosed with protruding points of the jogging part.

This invention further discloses a die for attaching a label to a flexible article, wherein the label suction surface has disposed therein depressions having a width in the range of 0.5 to 2 mm and a depth of not less than 0.1 mm and spaced by an interval in the range of 1 to 5 mm. This invention further discloses a die for attaching a label to a flexible article, wherein the label suction surface has depressions disposed latticewise therein. This invention further discloses a die for attaching a label to a flexible article, wherein the label suction surface has depressions disposed in an area accounting for 10 to 90% of the label suction surface, with the central part of the label suction surface as the center of the area.

BRIEF DESCRIPTION OF THE DRAWINGS

FIG. 1*a* is a plan view illustrating a typical label attaching die for a flexible article as one embodiment of this invention, FIG. 1*b* is a cross section taken through FIG. 1*a* along the line A—A. FIG. 1*c* is a cross section taken through FIG. 1*a* along the line B—B, FIG. 1*d* is a magnified plan view of the part C of FIG. 1*a*, FIG. 1*e* is a magnified cross section of the part C of FIG. 1*a*, FIG. 1*f* is a magnified plan view of the surface part of another typical label attaching die as another embodiment of this invention, and FIG. 1*g* is a magnified plan view of the surface part of the label attaching die, FIGS. 2*a* and *b* are diagrams typically illustrating the relation existing between a label and a die when the label is attached to a flexible article by the use of the label-attaching die of the present invention, FIGS. 3*a* and *b* are diagrams typically representing the relation existing between a label and a flexible article when the label is attached to the flexible article by the use of the label-attaching die of this invention.

DETAILED DESCRIPTION OF PREFERRED EMBODIMENTS OF THE INVENTION

A die 5 of this invention for the attachment of a label to a flexible article, as illustrated in FIGS. 1*a* to 1*e*, is saliently characterized by being provided with a label suction surface and the label suction surface having a regularly or irregularly jogging part 3 formed on the substantially entire surface thereof and having suction holes 4 disposed as enclosed with protruding points of the jogging part 3.

Figure 4A:
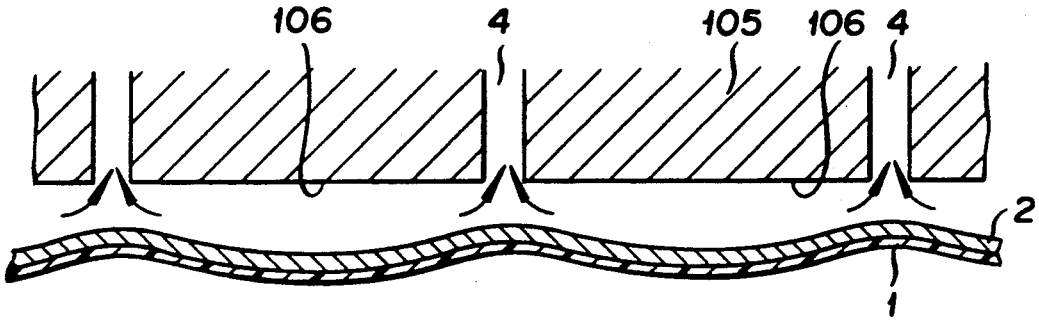
FIG. 4(a) (PRIOR ART)
Figure 4B:
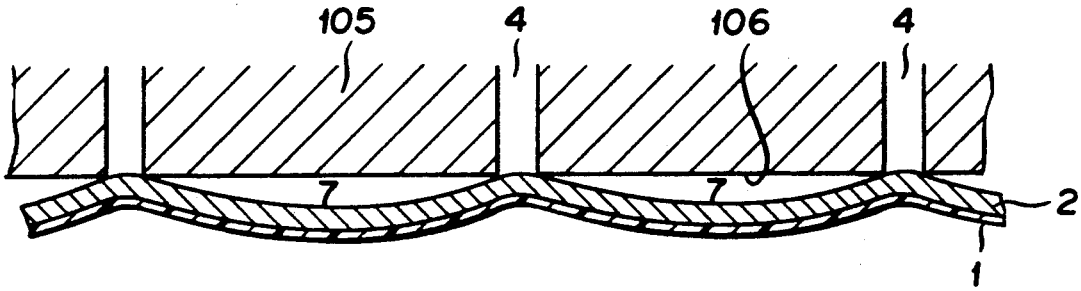
FIG. 4(b) (PRIOR ART)
Figure 5:
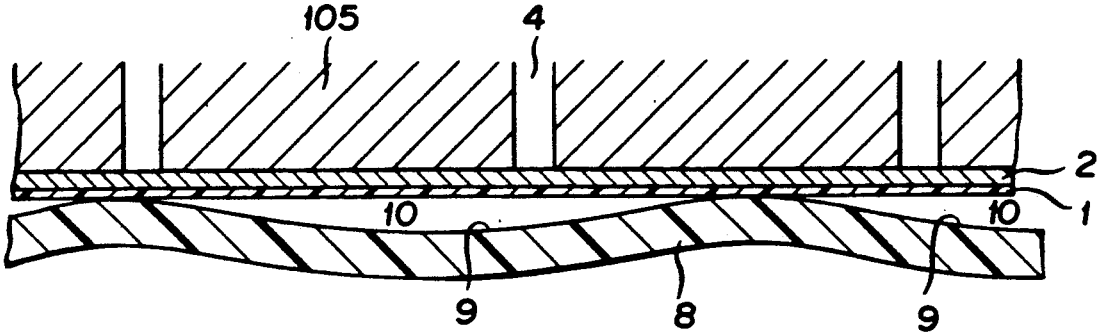
FIG. 5 (PRIOR ART)
FIG. 5 is a diagram typically representing the relation existing between a label and a flexible article with the label is attached to the flexible article by the use of the conventional label-attaching die.

To permit better comprehension of this invention, the problem encountered by the conventional label-attaching die will be described below with reference to the accompanying drawings. A conventional label-attaching die 105 is provided with a flat and smooth label suction surface 106 as illustrated in FIGS. 4*a* and *b*. When a label is attached to a flexible article by the use of this label-attaching die 105, therefore, the label 1 which is thin and pliable is readily bent at the time that the label is attracted tightly to the label suction surface 106 of the die 105 by drawing the ambient air in through the suction holes 1 as illustrated in FIG. 4*a*. Consequently, while the label 1 is tightly attached to the label suction surface 106 in the portions held contiguously with the suction holes 4 as illustrated in FIG. 4*b*, the air finds its way between the label and the label suction surface 106 in the other portions and gives rise to clusters of air 7. Thus, there is created the state in which the label 2 is incapable of adhering tightly to the label suction surface 106. In the portions of the label under which the clusters of air are formed, therefore, the clusters of air function as an insulating layer. Owing to this insulating layer, when the die 105 is heated, the heat is not sufficiently transferred to the label 2 and the thermosensitive adhesive agent on the adhesive layer 1 is not melted. In the portions under discussion, therefore, inferior adhesion occurs between the label and the flexible article. Further, when the label 1 attracted tightly to the label suction surface 106 of the die 105 is pressed against the label-applying surface 9 of the flexible article the label-applying surface produces a slight jogging contour because of the flexibility of the article. The air is consequently entrapped between the label 1 and the label-applying surface 9 as illustrated in FIG. 5. The clusters of air 10 formed by the entrapped air inhibit the label 1 from adhering fast to the label-applying surface In the portions of the label under which these clusters of air have been formed, therefore, inferior adhesion is suffered to occur.

Figure 2A:
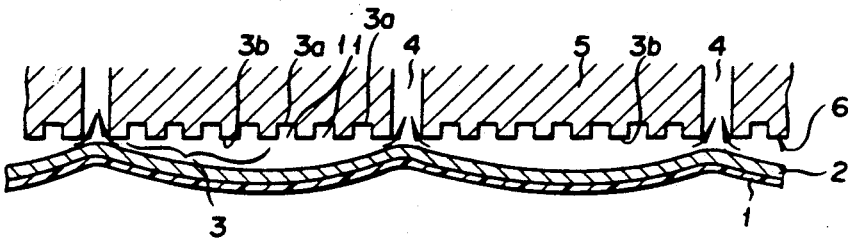
Figure 2B:
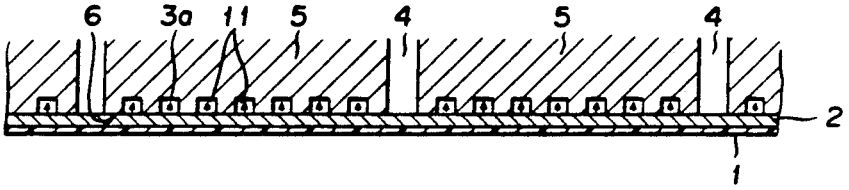
Figure 3A:
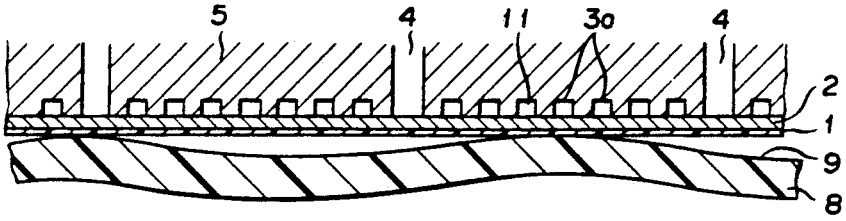
FIG. 3*c* is a magnified view of part of FIG. 3*b*, FIGS. 4*a* and *b* are diagrams typically representing the relation existing between a label and a die when the label is attached to a flexible article by the use of a conventional label-attaching die.
Figure 3B:
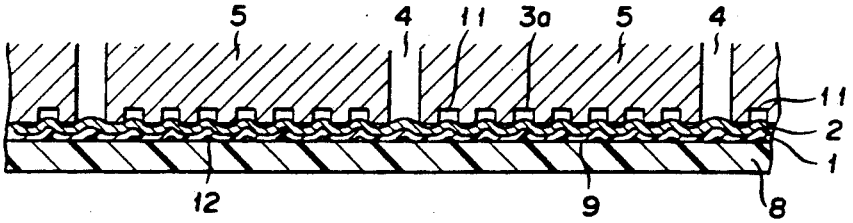
Figure 3C:
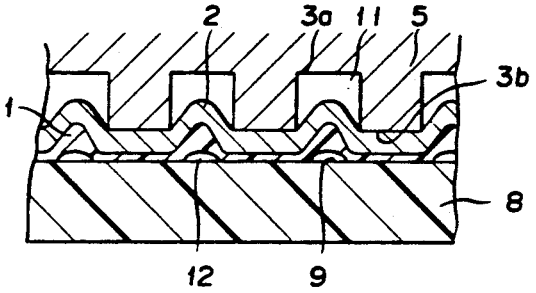

In contrast, in the case of a label-attaching die 5 of this invention, even when the label 2 bends and the air finds its way between the label suction surface and the label 2 at the time that the label 2 is attracted tightly to the label suction surface of the die by drawing the ambient air in through the suction holes 4 as illustrated in FIG. 2*a*, the air is dispersed in empty spaces as voids 11 formed by the jogging part 3 imparted to the label suction surface 6 as illustrated in FIG. 2*b* and consequently prevented from forming clusters of air. As the result, the label 2 is attached uniformly and tightly to the entirety of the label suction surface 6 and, owing to the heat applied to the die 5, the thermosensitive adhesive agent of the adhesive layer 1 of the label is thoroughly and uniformly melted throughout. Even when the label-applying surface 9 of the flexible article has a jogging contour and the air is entrapped between the label 2 and the label-applying surface as illustrated in FIG. 3*a* at the time that the label 2 attracted tightly to the label suction surface 9 of the die is pressed against the label-applying surface of the flexible article 8, the label 2 is allowed to bend under the applied pressure in such a manner as to enter the depressions 3*a* of the die 5 as illustrated in FIGS. 3*b* and 3*c* and the adhesive layer 1 of the label are caused to acquire a multiplicity of uniform and minute depressions 12. Thus, the air is dispersed in the depressions 12 and is prevented from forming clusters of air. As the result, the label is attached uniformly and tightly to the label-applying surface 9 of the flexible article 8. Further, when the multiplicity of uniform and minute depressions 12 are formed as described above in the adhesive layer 1 of the label, the thermosensitive adhesive agent present in the adhesive layer 1 of the label 2 in the portions in which the adhesive layer 1 contacts the label-applying surface of the flexible article 8 is caused by the applied pressure to flow partly into the adjoining depressions 12. As the result, the thermosensitive adhesive agent layer at the portions held in contact with the label-applying surface of the flexible article becomes thinner and can be expected to manifest a distinctly increased adhesive force.

Now, the present invention will be described more specifically below with reference to preferred embodiments.

The die 5 of this invention for the attachment of a label to a flexible container, as illustrated in FIGS. 1*a* to 1*e*, is provided with a label suction surface 6. This label suction surface has a regularly or irregularly jogging part formed substantially on the entire surface thereof and have suction holes disposed as enclosed with the protuberances 3*a* of the jogging part 3.

On the label suction surface of the die the jogging part 3 is formed substantially throughout the entire surface thereof as illustrated in FIGS. 1*d* and 1*e*. The jogging part 3 comprises recesses formed in any desired pattern on the label suction surface 6. It may be obtained, for example by shaping the depressions 3*a* in lines, lattices, dots, etc. Preferably, the jogging part is formed so that the depressions 3*a* may be disposed latticewise as illustrated in FIG. 1*a* and FIGS. 1*d* and 1*e*. Though the jogging part 3 may be patterned regularly or irregularly, it is desired to be formed regularly. The depressions 3*a* of the jogging part 3 are desired to have a width in the range of 0.5 to 2 mm, preferably 0.5 to 1.0 mm, and a depth of not less than 0.1 mm, preferably not less than 0.5 mm, and to be spaced by an interval in the range of 1 to 5 mm, preferably 2 to 3 mm. Further, the depressions 3*a* are desired to be disposed in an area accounting for 10 to 90%, preferably 40 to 70%, of the label suction surface, with the central part of the label suction surface 6 of the die 5 as the center thereof.

In the label suction surface of the die a plurality of suction holes 4 are performed as enclosed with the projections 3*b* of the jogging part These suction holed 4 communicate with a cavity 13 formed inside the die 5. The cavity 13 is intended to communicate with suction means at the time that the die 5 is set in place in a press. In FIGS. 1*a* to *e*, the suction holes 4 are depicted as being disposed in the protuberances of the jogging part 3. They may be otherwise disposed in the depressions 3*a* of the jogging part 3 as illustrated in FIGS. 1*f* and *g* so long as they are enclosed with the protuberances 3*b*. The die 5 in the present embodiment is further provided with a heater insertion hole 14 for the insertion of a heater as heating means and with a thermometer insertion hole 15 for the insertion of a thermometer (thermocouple).

The application of a label to a flexible article by the use of the label-attaching die which is constructed as described above is accomplished as follows.

First, the cavity 13 of the die is caused to communicate with a suction device (not shown) and a heater is set in place in the heater insertion hole 14 of the die In the die of the present embodiment, the heater inserted in the heater insertion hole 14 is utilized as heating means. Of course, the heating means need not be limited to this heater but may be any device which is required only to be capable of heating the label suction surface 6 of the die to a desired temperature. Further a thermocouple is inserted in the thermometer insertion hole 15 of the die 5.

After these necessary devices have been set in place in the die 5 as described above, the label suction surface 6 of the die 5 is brought into tight contact with the label. This label 2 is provided with an adhesive layer produced by application of a thermosensitive adhesive agent using an ethylene-vinyl acetate copolymer, polyethylene, polypropylene, an ethylene-ethyl acrylate copolymer, a polyamide, or a polyester as a principal component thereof. When the suction device mentioned above is actuated while the label suction surface 6 of the die 5 is held in tight contact with the label 2, the label 2 is attached fast to the label suction surface as the suction holes 4 communicating with the cavity 13 simultaneously attracts the label 2 and draw in the ambient air.

Since the label suction surface 6 of the die 5 is provided substantially on the entire surface thereof with the jogging part as described above, the air which possibly finds its way between the label suction surface 6 and the label 1 is dispersed into the empty spaces formed by the jogging part 3. Thus, the label 2 is attached uniformly and tightly to the label suction surface 6.

Now, the die 5 keeping the label 2 attached tightly thereto is set on the label-applying surface of the flexible article so as to press the label 2 against the label-applying surface When the flexible article 8 to which the label 2 is attached is a flexible container such as, for example, a blood bag or a transfusion bag, the attachment of the label may be carried out while the container is filled with its content or while the container is not filled with the content. Even when the container is filled with its content and the label-applying surface 9 thereof is liable to produce a contour, the air possibly entrapped between the label 2 and the label-applying surface as described above is dispersed in the multiplicity of uniform and minute depressions 12 on the adhesive layer 1 of the label to be formed by the depressions 3*a* of the die 5. Thus, the label 2 is allowed to adhere uniformly and tightly to the flexible article.

In this case, since the label suction surface 6 of the die has been already heated to a temperature in the neighborhood of 140°35° C. to 145°2° C. by the heater placed inside the heater insertion hole 14, the thermosensitive adhesive agent of the adhesive layer 1 of the label 2 is melted by this heat and allowed to adhere fast to the flexible article 8.

Thereafter, the suction of the label by the suction means is stopped and the label-applying surface 6 of the die 5 is moved away the flexible article 8 to discontinue the pressed contact and complete the attachment of the label. The thermosensitive adhesive agent applied fast in a molten state to the flexible article is gradually cooled and solidified in the air to fasten the label with high adhesiveness to the flexible article 8.

The label once applied to the flexible article by the use of the label-attaching die of this invention does not peel off the flexible article because the adhesive agent is a thermosensitive substance. The thermosensitive label which is thus destined to acquire a tamperproof (sealing) function, therefore, can be attached with high uniformity and adhesiveness to the surface of the flexible article as described above. The die of this invention accordingly, contributes very advantageously to the attachment of a label to a flexible article, particularly to a flexible medical container such as, for example, a blood bag or a transfusion bag.

Now, the present invention will be described more specifically below with reference to working examples.

EXAMPLE

As a die for incorporation in a heating type press, a die provided with a label suction surface 95×95 mm in area and having grooves 0.8 mm in width and 1 mm in depth disposed latticewise on the label suction surface in an area of 70×70 mm, with the central part of the label suction surface as the center thereof was used. When labels are attached continuously to flexible containers one after another by the use of this die, the percent defective was as low as less than 0.1%.

Control

Continuous attachment of labels to flexible containers was carried out by following the procedure of the example described above, excepting a die provided with a flat smooth label suction surface 95×95 mm in area was used as a die for incorporation of a heating type press. In this case, the percent defective was on the order of 2 to 3%.

From the results described above, it is clearly noted that the use of the label-attaching die of this invention brought about a notable decrease in the percent defective in the attachment of labels.

Economic Utility of the Invention

As described above, this invention is directed to a label-attaching die provided on one surface thereof with an adhesive layer produced by application of a thermosensitive adhesive agent and used for the attachment of a label to a flexible article, which label-attaching die is characterized by being provided with a label suction surface and the label suction surface having a regular or irregular jogging part formed substantially throughout the entire surface thereof and suction holes disposed as enclosed with the protuberances of the jogging part.

Even when the air is suffered to find its way between the label and the label-applying surface of the flexible container at the time that the label is attached to the flexible article by the use of this die, the jogging contour imparted to the label suction surface of the die functions to dispersed the air and consequently create a state substantially free from clusters of air. Thus, the label can be attached with high uniformity and adhesiveness to the surface of the flexible article. Further, since the attachment of the label is attained with the thermosensitive adhesive agent, the adhesive force is so strong as to preclude the possibility of the attached label peeling off the surface of the flexible article. For the attachment of a label to a flexible article for which the accidental or intentional separation of the attached label entails a serious problem as in the case of a medical container such as, for example, a blood bag or a transfusion bag, the die of this invention is used ideally. The attachment of a label to a flexible article is attained with enhanced uniformity and tightness when the die of this invention is provided on the label suction surface thereof with depressions 0.5 to 2 mm in width and not less than 0.1 mm in depth disposed in an area accounting for 10 to 90% of the label suction surface, with the central part of the label suction surface as the center thereof.

What is claimed is:

1. A label-attaching die for attaching to a flexible article a pliable label having a layer of thermosetting adhesive on a side thereof which is to be applied against the article, said label-attaching die being heated and provided with a label suction surface for gripping a non-adhesive side of the label, said suction surface including a jogging section with suction holes operatively connected to a suction means, said suction holes being disposed in said jogging section for admitting suction from said suction means which removes a portion of the air from between the label and the jogging section and which sucks the non-adhesive side of the label against aid suction surface, said jogging section including recesses situated between said suction holes, said recesses defining voids for receiving portions of the label pushed therein by air trapped between the label and the article.

2. A label-attaching die according to claim 1, wherein said recesses have a width in the range of 0.5 to 2 mm and a depth of not less than 0.1 mm and being spaced by an interval in the range of 1 to 5 mm.

3. A label-attaching die according to claim 1, wherein said recesses are disposed in an area accounting for ten to ninety percent of said label suction surface.

4. A label-attaching die according to claim 1, wherein said recesses are disposed in an area accounting for forty to seventy percent of said suction surface.

5. A label-attaching die according to claim 1, wherein said recesses are formed by intersecting grooves.

6. A label-attaching die according to claim 5, wherein said suction surface includes peripheral edges, said intersecting grooves terminating short of said edges.

7. A label-attaching die according to claim 1, wherein said jogging section is surrounded by another portion of said suction surface which is free of said suction holes and recesses.

8. Apparatus for attaching to an article a pliable label having a layer of thermosetting adhesive on a side thereof which is to be applied against the article, said apparatus comprising supporting means for supporting an article, and a die disposed opposite said supporting means for carrying the label which is attached to the article when the die and article are pressed together, said die comprising a suction surface for gripping a non-adhesive side of the label, said label suction surface including suction holes operatively connected to a suction means for admitting suction which removes a portion of the air from between the label and the jogging section and which sucks the non-adhesive side of the label against said suction surface, means for heating said die whereby heat is transferred through said suction surface to the label, said suction surface including recesses situated between said suction holes, said recesses defining voids for receiving the remaining portion of air trapped between said suction surface and the label, and for receiving portions of the pliable label pushed thereinto by air trapped between the label and article.

9. A method of attaching to an article a pliable label having a layer of thermosetting adhesive on a side thereof which is to be applied to the article, said method utilizing a die having a suction surface with suction holes therein and recessses disposed between said suction holes defining voids in said suction surface, said method comprising the steps of: heating said die and admitting suction through said suction holes to suck a non-adhesive side of the label against suction surface, whereby air trapped between said suction surface and the label enters said voids; and pressing the die against the article, whereby air trapped between the label and the article pushes portions of the pliable label into said voids.

* * * * *

UNITED STATES PATENT AND TRADEMARK OFFICE

CERTIFICATE OF CORRECTION

PATENT NO. : 5,100,491

DATED : March 31, 1992

INVENTOR(S) : Takao Ijiri et al.

It is certified that error appears in the above-identified patent and that said Letters Patent is hereby corrected as shown below:

On the title page, the second inventor's name in [75] is changed to:

Shoji Sakakiyama

Signed and Sealed this

Twenty-ninth Day of June, 1993

*Attest:*

Michael K. Kirk

MICHAEL K. KIRK

*Attesting Officer*

*Acting Commissioner of Patents and Trademarks*